US007552883B2

(12) United States Patent
Kinnunen et al.

(10) Patent No.: US 7,552,883 B2
(45) Date of Patent: Jun. 30, 2009

(54) CRUSHING DEVICE

(75) Inventors: Kauko Kinnunen, Jyväskylä (FI); Hannu Heinäsenaho, Jyväskylä (FI); Hannu Urpalainen, Lahti (FI)

(73) Assignee: Tana Oy, Vaajakoski (FI)

( * ) Notice: Subject to any disclaimer, the term of this patent is extended or adjusted under 35 U.S.C. 154(b) by 106 days.

(21) Appl. No.: 11/661,012

(22) PCT Filed: Aug. 22, 2005

(86) PCT No.: PCT/FI2005/050295

§ 371 (c)(1),
(2), (4) Date: Feb. 22, 2007

(87) PCT Pub. No.: WO2006/053941

PCT Pub. Date: May 26, 2006

(65) Prior Publication Data

US 2008/0087753 A1 Apr. 17, 2008

(30) Foreign Application Priority Data

Aug. 24, 2004 (FI) ..... 20045304

(51) Int. Cl.
*B02C 18/16* (2006.01)

(52) U.S. Cl. ..... 241/243; 241/285.3

(58) Field of Classification Search ..... 241/285.1, 241/285.2, 285.3, 101.2, 66, 67, 235, 236, 241/242, 243
See application file for complete search history.

(56) References Cited

U.S. PATENT DOCUMENTS

| | | | | |
|---|---|---|---|---|
| 3,845,907 | A | 11/1974 | Schwarz | |
| 4,082,232 | A | 4/1978 | Brewer | |
| 4,192,471 | A * | 3/1980 | Beckman et al. | 241/205 |
| 4,905,920 | A * | 3/1990 | Siwersson et al. | 241/258 |
| 5,052,630 | A | 10/1991 | Hinsey et al. | |

FOREIGN PATENT DOCUMENTS

| | | |
|---|---|---|
| DE | 3540896 | 5/1987 |
| EP | 0629447 | 12/1994 |

* cited by examiner

*Primary Examiner*—Mark Rosenbaum
(74) *Attorney, Agent, or Firm*—Fildes & Outland, P.C.

(57) ABSTRACT

The invention relates to a crushing device, which includes a frame structure and a rotor mounted rotatably in bearings in it. In addition, shredder elements are arranged in connection with the frame structure and the rotor, and a hydraulic motor is connected to the rotor through a power transmission. The material fed to the crushing device is arranged to travel through the shredder elements while at the same time being crushed into smaller pieces when the rotor is rotated by the hydraulic motor. At at least one end of the rotor, the rotor is fitted to the frame structure by means of a pivot joint, which permits a difference of angle between the rotor and the frame structure.

12 Claims, 4 Drawing Sheets

CRUSHING DEVICE

TECHNICAL FIELD

The present invention relates to a crushing device, which includes

- a frame structure and a rotor mounted rotatably in bearings in it,
- shredder elements, which are arranged in connection with both the frame structure and the rotor, and
- a hydraulic motor connected to the rotor through a power transmission, the material fed to which crushing device being arranged to travel through the shredder elements while at the same time being crushed into smaller pieces when the rotor is rotated by the hydraulic motor.

BACKGROUND OF THE INVENTION

Crushing devices, such as a shredder are used, for example, to crush municipal waste or car tyres. A crushing device generally has at least one generally slowly rotating rotor, in which there are shredder elements to create a crushing effect. To achieve a suitable rotation speed, the crushing device generally has a power transmission containing gears, to which a hydraulic motor is connected. Electric motors can also be used, though a hydraulic motor will withstand large loading variations better than an electric motor. In practice, the rotor may even stop completely, which would cause problems in an electric-motor drive. The material is usually fed to the shredder from above while the crushed material falls below the shredder by gravity.

U.S. Pat. No. 5,052,630 discloses a shredder, in which various blades are fitted next to each other on a shaft, to form the rotor. The shaft itself is supported at both ends on large bearings in the frame structure of the shredder. In addition, a hydraulic motor is connected as a continuation of the shaft through a rigid clutch. The frame structure forms a throat, in which the rotor formed from the blades is located. In addition, counter-blades are fitted to both sides of the throat. Thus the drum can be rotated in both directions while crushing the material between the blades and the counter-blades.

In the shredder described above, as in other known shredders, large and complex bearings must be used. In addition, the bearings must generally be dismantled to be able to service the rotor. The rotor support of this kind also limits the maximum length of the rotor. In practice, the rotor deflects and otherwise flexes radially, which strains the bearings and may cause structural damage. In addition, in the above US patent the hydraulic motor is connected directly to the shaft, so that angular changes in the shaft also place a strain on the hydraulic motor, which is rigidly supported in the frame structure.

SUMMARY OF THE INVENTION

The invention is intended to create a new type of crushing device, which has a construction that is simpler but more durable than before.

Accordingly, a crushing device includes a frame structure and a rotor mounted rotatably in bearings in it. Shredder elements are arranged in connection with both the frame structure and the rotor. A hydraulic motor is connected to the rotor through a power transmission. The material is fed to the crushing device and is arranged to travel through the shredder elements while at the same time being crushed into smaller pieces when the rotor is rotated by the hydraulic motor. At at least one end of the rotor, the rotor is fitted to the frame structure by means of a pivot joint, which permits a difference of angle between the rotor and the frame structure.

The pivot joint may be fitted between the frame structure and the bearing. The pivot joint may be fitted between the bearing and the rotor. The pivot joint may be a functional universal joint. The crushing device may include two essentially similar rotors fitted parallel to each other longitudinally. At at least one end of the rotor the power transmission may include a planet gearbox, which is arranged to be attached to the pivot joint arranged also to transmit a moment, and the rotor end in question is thus bearing-mounted on the frame structure using the bearings of the planet gearbox. The planet gearbox may be arranged to form a hub motor that includes a reduction gear train, and to which a high-speed hydraulic motor is connected. The bearings may be fitted between a case and a flange belonging to the hub motor. The pivot joint may be attached to either the case or the flange. The hub motor may be attached rigidly by its case to the rotor the pivot joint being between the flange and the frame structure. A hub motor may be fitted to both ends of the rotor. The rotor may be formed of a tube, in which there are flange ends for attaching the rotor. Inside the tube may be a medium filling and/or circulation for controlling the temperature of the power transmission connected to the rotor. The frame structure may include attachment lugs in both the upper and the lower part, for fitting the crushing device as part of a larger apparatus, which is arranged to be fixed or mobile.

In the crushing device according to the invention, the support of the rotor and at the same time the entire power transmission of the crushing device is arranged in a new and surprising manner. The rotor has a floating support, by means of which the disadvantageous loading of the bearings is avoided and the hydraulic motor avoids external stress. At the same time the service of the crushing device is easier than before. In addition, the bearing arrangement is preferably arranged as part of the power transmission, so that the construction of the crushing device is further simplified. The new type of rotor, the bearing arrangement, and the construction and support of the power transmission permit the rotor to be dimensioned freely and for the same components to be used in crushing devices of different sizes.

BRIEF DESCRIPTION OF THE DRAWINGS

In the following, the invention is examined in detail with reference to the accompanying drawings showing some embodiments of the invention.

DETAILED DESCRIPTION OF THE INVENTION

Figure 1A:
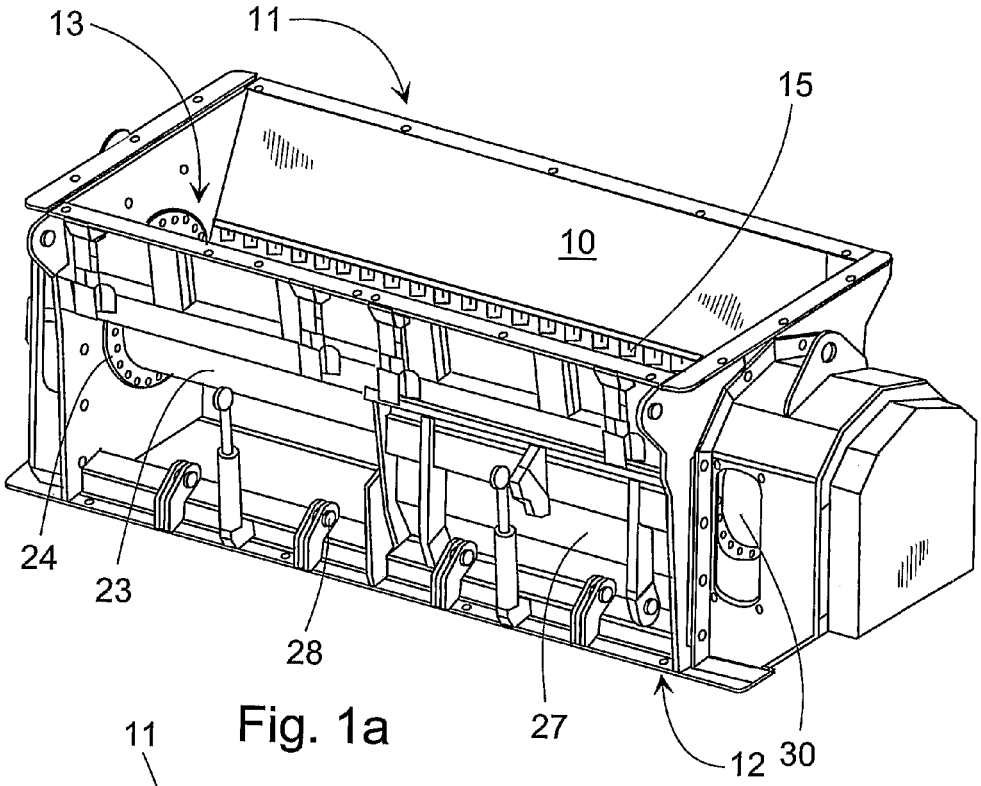
FIG. 1*a* shows an axonometric view of the crushing device according to the invention partially dismantled.
Figure 1B:
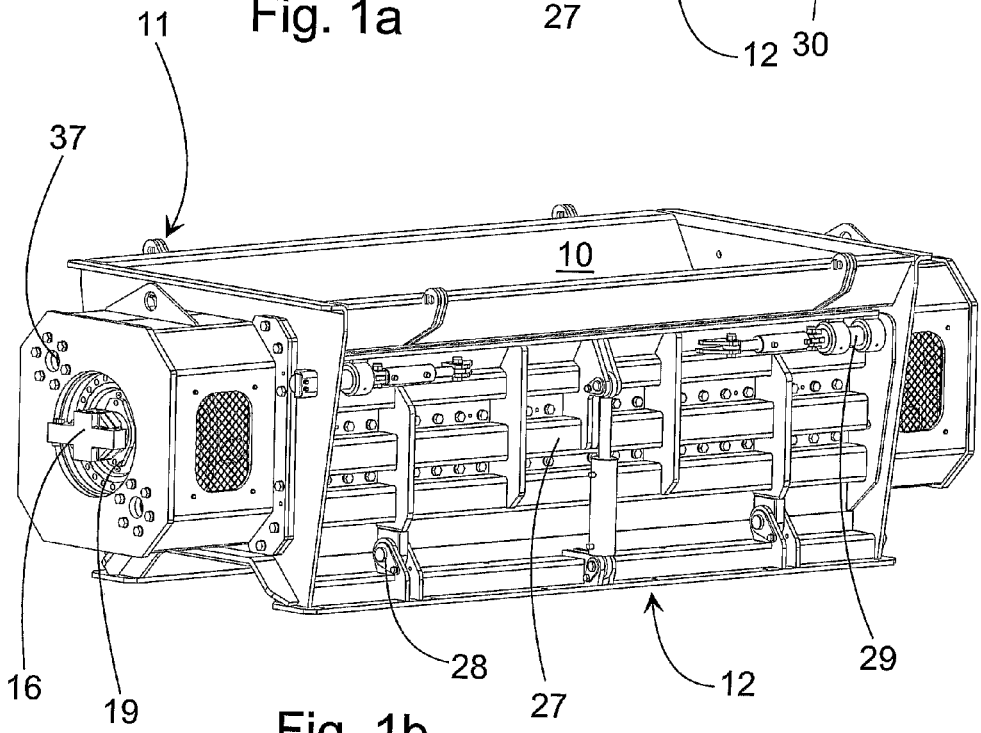
FIG. 1*b* shows an axonometric view of a second embodiment of the crushing device according to the invention.

FIGS. 1*a* and 1*b* show the crushing device according to the invention without ancillary devices. Hereinafter the crushing device will be referred to as a shredder, the frame structure 10 of which is mainly manufactured from steel tubes and plates and which is open from its upper and lower parts. The frame structure 10 also includes attachment lugs 11 and 12 in both the upper and lower parts, for fitting the shredder as part of a larger apparatus. In practice, a feed funnel is attached to the upper part of the frame structure and an outlet funnel (not shown) correspondingly to the lower part. In addition to the various funnels and possibly conveyors, the shredder includes a control system and a power source, which is connected to the power transmission package according to the invention. Depending on the application, the shredder is either fixed or mobile.

Figure 3A:
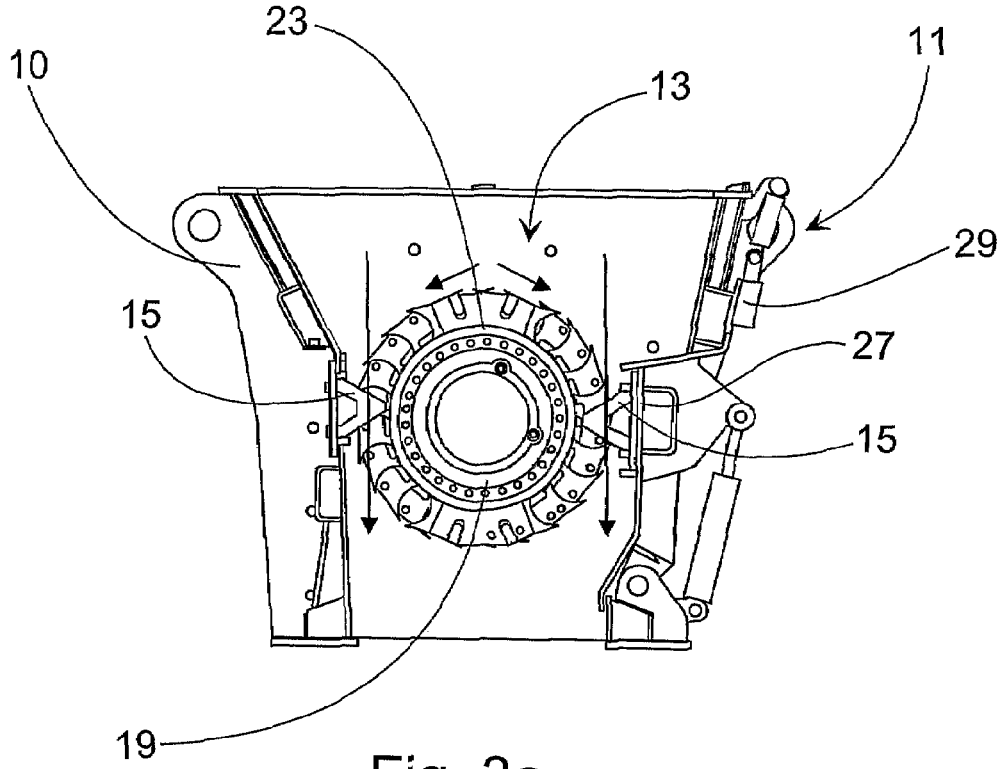
FIG. 3*a* shows a cross-section of the shredder according to the invention.
Figure 3B:
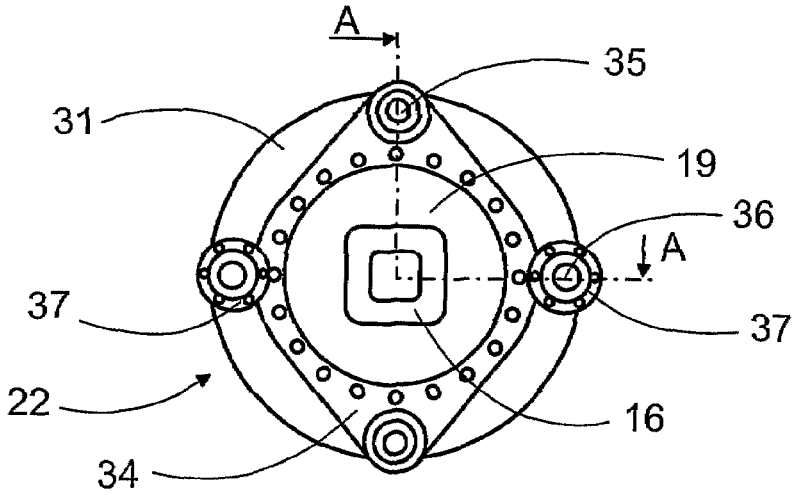
FIG. 3*b* shows the pivot joint of FIG. 4 seen from the axial direction.

The shredder also includes a rotor 13, which is attached rotatably by bearings at its ends to the frame structure 10. In addition, there are numerous shredder elements 14 and 15 in the shredder, which are arranged in connection with both the frame structure 10 and the rotor 13 (FIG. 3*a*). The power source used can be selected case-specifically, but the rotor is preferably rotated by a hydraulic motor, which is fitted to the power transmission package. Thus, for example, a diesel engine is used to drive a hydraulic pump, which rotates a hydraulic motor. In addition, the hydraulic motor 16 is connected to the rotor 13 through the power transmission. In practice, the material fed to the shredder travels through the shredder elements 14 and 15 while at the same time being crushed into smaller pieces as the rotor 13 is rotated by the hydraulic motor 16.

According to the invention, at least at one end of the rotor 13, the rotor 13 is fitted to the frame structure 10 by means of a pivot joint 38, which permits a difference of angle between the rotor 13 and the frame structure 10. During crushing, this avoids deflection of the rotor and/or additional strain on the bearing caused by errors of angle that have arisen during manufacture. At the same time, larger manufacturing tolerances can be applied. In principle, a hub motor could be attached rigidly to both the rotor and the frame structure, which would, however, lead to the problems described above. Generally the pivot joint is fitted between the frame structure and the bearing, or between the bearing and the rotor. This means that there is a diversity of support constructions that can be selected for different applications, and which allow the pivot joint to operate as designed. In addition, the pivot joint is functionally a universal joint, which both permits differences of angle and transmits moment. More details of the construction of the pivot joint are given later.

In addition, at least one end of the rotor the power transmission is formed of a planet gearbox 17, which is fitted between the frame structure 10 and the rotor 13. Thus the rotor end in question is mounted in the frame structure 10 on the bearings 18 of the planet gearbox 17. In other words, the separate rotor bearings used in the prior art are unnecessary, which considerably simplifies the construction of the shredder. According to the invention, the planet gearbox 17 is preferably arranged as a hub motor 19 containing a reduction gear train, and which is connected to a high-speed hydraulic motor 16. The construction in question is compact, so that the power trans-mission package requires only a little installation space. In addition, the hub motor itself includes the planet gearbox, which permits the use of a high-speed hydraulic motor. The hub motor 19 and its bearings 18 are shown particularly in FIG. 4.

Figure 2A:
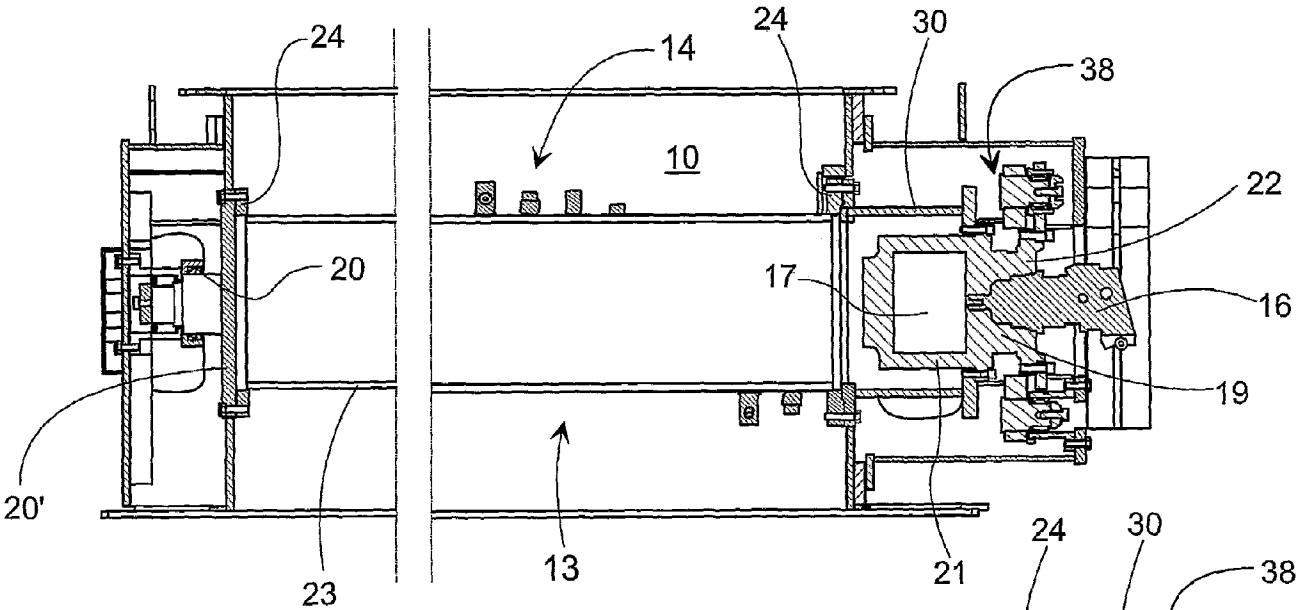
FIG. 2*a* shows a cross-section of the crushing device of FIG. 1*a*.
Figure 2B:
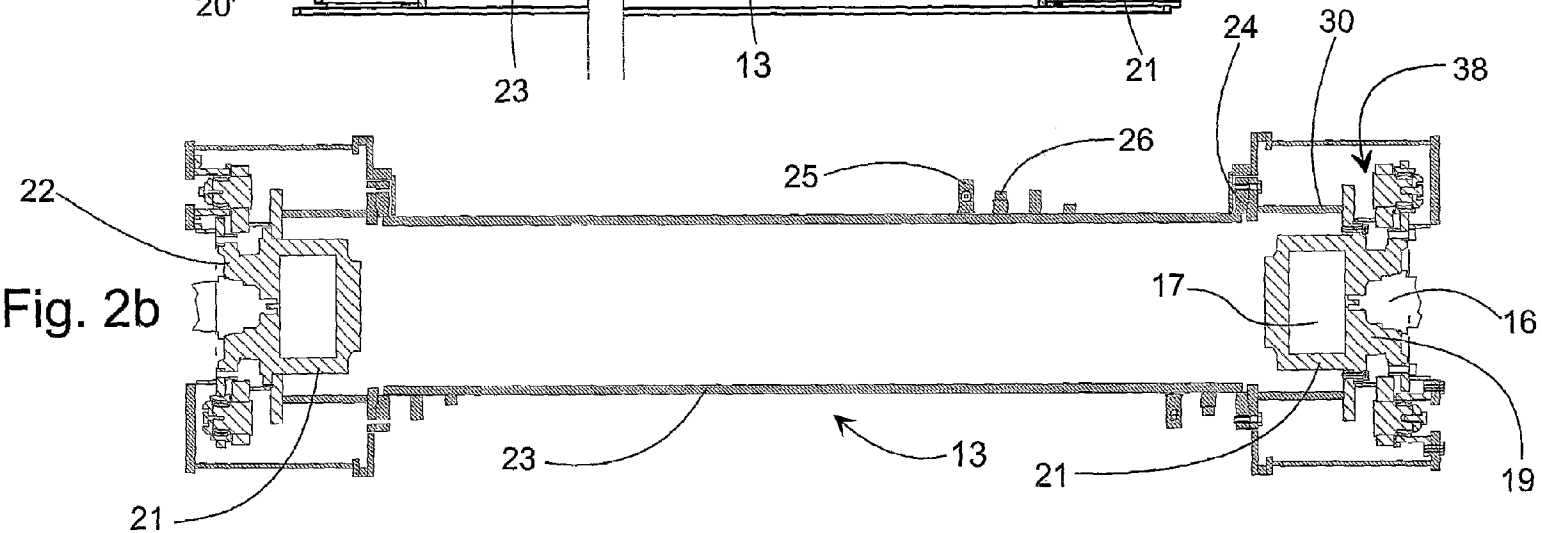
FIG. 2*b* shows a cross-section of the crushing device of FIG. 1*b*.

FIG. 2*a* shows an embodiment of the shredder, in which the power transmission package according to the invention is only at one end of the rotor. At the other end of the rotor there is a conventional bearing arrangement. However, the bearing 20 belonging to the bearing arrangement in question has a flange 20' attached to it, to which the rotor 13 is attached by a screw joint. Thus the rotor can be detached from the shredder simply, without detaching the bearings. In the embodiment of FIG. 2*b*, a hub motor 19 is fitted to both ends of the rotor 13. The construction of the shredder is thus modular, which makes it easy to manufacture shredders of different power and to utilize the same components. In addition, if a fault occurs the rotor can be rotated using even a single hub motor. In addition to increasing power, the use of a power transmission package at both ends of the rotor can be used to maximize the length of the shredder's life. Further, the capacity of the shredder can be increased by fitting two essentially similar rotors parallel to each longitudinally (not shown). In that case, the shredder will include two or four hub motors. As many as three parallel rotors can be used.

In practice, the hub motor 19 includes a case 21, which contains the gear wheels of the planet gearbox. In addition, there is a flange 22 in the hub motor, by means of which the hub motor is attached to the rest of the structure of the shredder. Between the case 21 and the flange 22, there are also the aforementioned bearings 18. In other words, the flange and the case rotate relative to each other. In the embodiment shown, the case 21 is connected to the rotor 13 and the flange 22 to the frame structure 10. If necessary, the hub motor can be arranged the other way round.

According to the invention, the hub motor 19 is thus preferably fitted to the shredder by means of a pivot joint 38, which is arranged to be attached to either the case 21 or the flange 22. In practice, the pivot joint 38 is a functional universal joint, which transmits moment but nevertheless permits a difference of angle between the rotor 13 and the frame structure 10. Thus the bearings 18 of the hub motor 19 are quite sufficient as the only bearings of the rotor 13, which at the same time avoid the strain caused by the deflection of the frame and the rotor. In addition, machining of the frame structure and the rotor is avoided in manufacture, thus reducing manufacturing costs. In the embodiment shown, the pivot joint is fitted between the flange and the motor case belonging to the frame structure. In other words, the hub motor's case is rigidly attached to the rotor. The flange and the hydraulic motor, on the other hand, do not rotate. In the embodiment of FIG. 2*a*, the end of the rotor 13 without a motor is mounted in ball-like roller bearings 20.

According to the invention, the rotor 13 is formed from a tube 23, which achieves a light but stiff structure. In addition, the interior of the tube can be utilized by arranging a medium filling and/or circulation in it, in order to control the temperature of the power transmission connected to the rotor. The temperature of the hub motor will thus remain even, despite variations in the operating conditions or material being processed. The tube can be filled, for example, with a water-glycol mixture, so that the heat of the hub motor is transferred to the mixture and from it to the air surrounding the shredder. Inside the tube, baffles are also fitted, which are used to create turbulence in the mixture when the rotor rotates. In practice, the length of the rotor is from two to three meters and the diameter of the tube about 500 mm. The tube 23 of the rotor 16 is of structural steel and end flanges 24 are welded to both ends of it. The power transmission package according to the invention, or a simple bearing arrangement, depending on the application, is attached to the end flanges 24. In addition, attachment saddles 25, to which the replaceable blade pieces 26 that act as shredder elements 14, are welded onto the tube 23. In one application series, the blade pieces have three alternative widths of 40, 50, and 60 mm.

FIG. 3*a* shows a cross-section of the shredder according to the invention. The blade pieces 26 are set in a spiral pattern around the tube 23, so that only some of the blade pieces 26 are next to the counter blades 15 at any time. In this case, the counter blades 15 are attached by screw joints to a hatch arrangement 27, which is attached to the frame structure 10 by a hinge joint 28. The hatch arrangement 27 can be opened and closed by hydraulic cylinders and is locked by hydraulically operated locking pins 29. In FIG. 1*a*, there are two parallel hatch constructions 27, one of which is removed to reveal the rotor 13. In FIG. 1*b*, there is one hatch arrangement 27. The frame structures can also be attached to each other. The frame structure of FIG. 1*a* thus has two frame structures of FIG. 1*b*. The same reference numbers are used for components that are functionally similar.

Thus it is possible to use the hub motor and the bearings that retain it axially as the rotor's only bearing arrangement, because according to the invention the rotor is supported by the pivot joint on the frame structure. At the same time, the pivot joint permits an angular deviation caused by the deflection of the rotor, without causing excessive loading on the bearings. Generally, there is a power transmission arrangement according to the invention at least one end of each rotor. In that case, there will be a simple bearing arrangement, which permits angular deviation, at the end without a motor. In that case, self-aligning ball-like roller bearings are preferably used. The crushing power can easily be increased by fitting a hydraulic-motor unit and pivot joint to both ends of the rotor. On the other hand, even a conventional bearing can be supported by the pivot joint according to the invention. In addition, the power transmission can be arranged outside the rotor, if there is sufficient installation space. However, by using both a hub motor and a pivot joint it is possible to create a superior compact construction, which will withstand even rough use and which is also easy to service.

In the shredder, it is preferable to use a special tubular intermediate piece 30, inside which most of the hub motor 19 will fit. In other words, the entire power transmission package is outside the frame structure 10, where there is usually plenty of installation room. In addition, the entire length of the rotor can be used effectively. It is preferably to use screw joints to attach the rotor, through the separate pairs of screws and bolts are not shown in the figures. In addition, the rotor and the frame structure are dimensioned in such a way that by opening the screw joints the rotor can be lifted away from the shredder, without detaching or moving the bearing arrangement or power transmission (FIG. 2*a*). The construction is user-friendly and speeds up servicing. In the shredder it is also possible to rapidly change rotors equipped with different kinds of blade pieces, if the work demands this. In addition, by increasing the size of the intermediate piece, even a large hub motor can be fitted to the end of a rotor that is of an advantageous size in terms of crushing. In the embodiments described, the hub motor could even fit inside the rotor, but by using the intermediate piece according to the invention it is possible to use hub motors that are even considerably larger than this.

According to the invention, the rotor is thus supported on the frame structure with the aid of a pivot joint. In addition, a hub motor connected to the pivot joint is preferably used. Usually a functional universal joint with a known mechanism comprises two fork structures and a crosspiece. However, the practical implementation of the pivot joint according to the invention uses different kinds of components. In this case, the first fork structure is attached to either the case 21 or flange 22 of the hub motor 19. Correspondingly, the second fork structure is attached to the opposite structure of the flange 22 or case 21 of the hub motor 19, in this case to the intermediate piece 30 attached to either the motor case or the rotor 13. In addition, the second fork structure is set at an angle of 90° relative to the first fork structure. The crosspiece 31 connecting the fork structures is attached to each fork structure with the aid of two pairs of pivots 32 and 33. The pairs of pivots 32 and 33 are, in addition, on essentially the same plane.

In order to create a functional universal joint, a plate structure 34 is attached to the flange 22. The plate structure carries the two pivots set symmetrically at a distance apart relative to the axis of rotation of the rotor, thus forming the first pivot pair 32 to carry the crosspiece 31. In addition, the motor case is carried symmetrically with the aid of two pivots forming the second pivot pair 33 set relative to a continuation of the axis of rotation of the rotor. The pivots in question are further supported with the aid of the said crosspiece 31.

Figure 4:
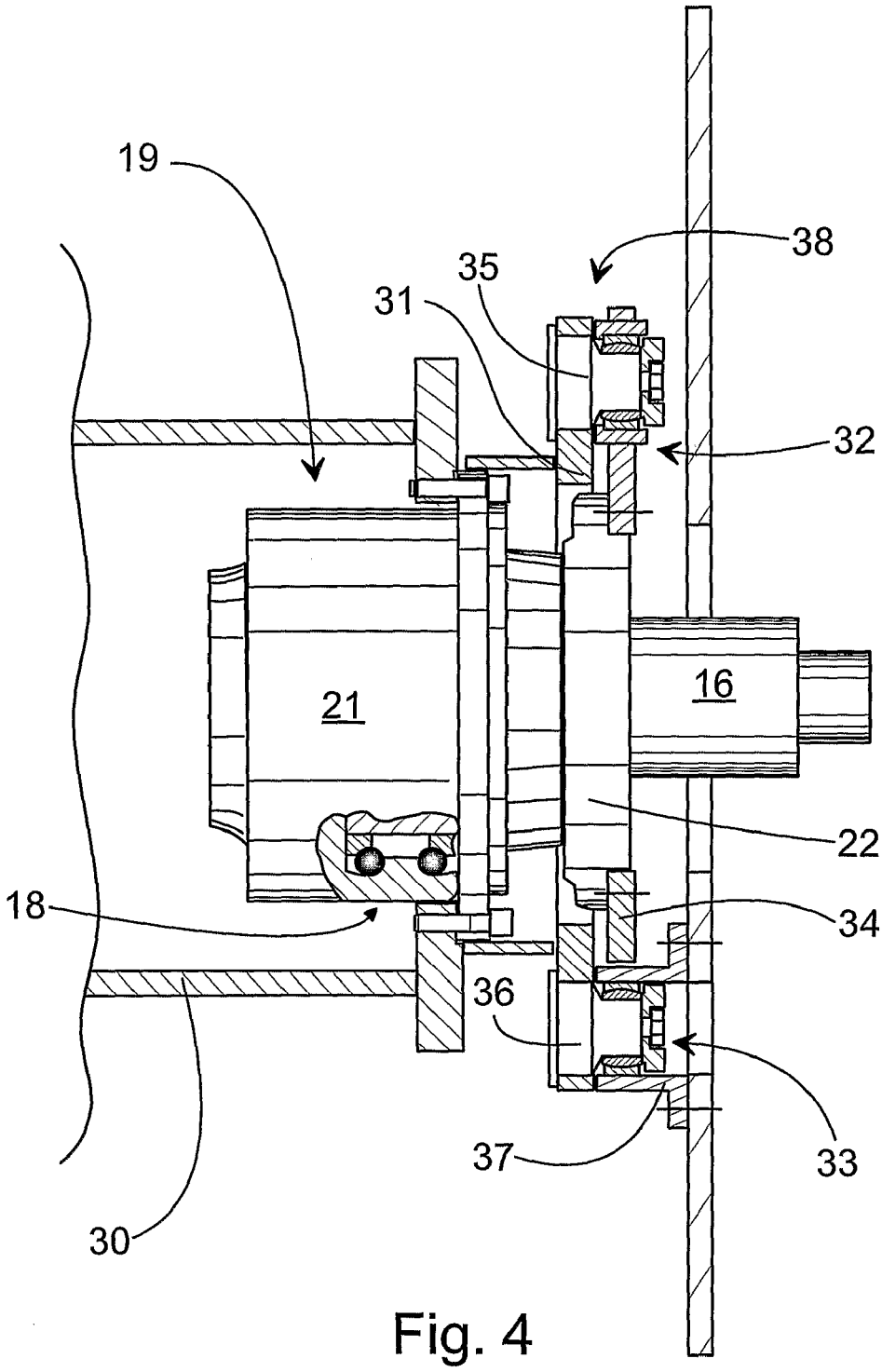
FIG. 4 shows a cross-section of the pivot joint according to the invention on plane A-A of FIG. 3*b*.

The crosspiece 31 is preferably formed by a circular ring arranged around the hub motor 19, and which includes the pivot pins 35 and 36 of the aforementioned pivot pairs 32 and 33. The pivot pairs 32 and 33 are preferably ball joints, which form the functional bearings of the functional universal joint. In the example, the horizontal pivot pair 33 is arranged on two brackets 37 to be attached rigidly to the motor case. The brackets 37 are arranged again to the motor case, preferably using screw joints. The motor case can also be easily detached, which facilitates servicing. Instead of the ball joints, it is possible to use some other support that will permit mutual movement between the crosspiece and the plate structure. In FIG. 4, the crosspiece 31 is fitted to the rotor 13 side of the plate structure 34, so that the total length of the power transmission arrangement will be as short as possible. The use of the solution according to the invention thus creates a joint construction, which permits a deviation of angle between the rotor and the end piece. However, the joint construction is rigid axially and radially and will transmit even large moments.

Various forces and moments are transmitted through the hub motor and pivot joint from the motor case to the rotor. In the example solution of FIG. 4, the force is transmitted through the brackets 37 attached to the motor case, through the horizontal pivot pair 33 to the crosspiece 31. From the crosspiece 31, the force is transmitted onward through the vertical pivot pair 32 to the plate structure 34. From the plate structure 34 the force continues through the flange 22 to the case 21 and from there on through the intermediate piece 30 to the rotor 13. Thus the rotor is supported on the frame structure and the rotational movement of the hub motor is transmitted to the rotor. In addition, the bearings of the hub motor can used as the only bearings, as the pivot joint permits the angle of the rotor to deviate.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

The invention claimed is:

1. Crushing device, which includes a frame structure and a rotor having ends mounted rotatably to the frame structure by bearings, shredder elements, which are arranged in connection with both the frame structure and the rotor, and a hydraulic motor connected to one said end of the rotor through a power transmission, material fed to the crushing device being arranged to travel through the shredder elements while at the same time being crushed into smaller pieces when the rotor is rotated by the hydraulic motor, characterized in that at at least one end of the rotor, the rotor is fitted to the frame structure by means of a pivot joint, which permits a difference of angle between the rotor and the frame structure, the pivot joint being fitted between the frame structure and the bearing at the end of the rotor that is connected to the hydraulic motor.

2. Crushing device according to claim 1, characterized in that the pivot joint is a functional universal joint.

3. Crushing device according to claim 1, characterized in that the crushing device includes two essentially similar rotors fitted parallel to each other longitudinally.

4. Crushing device according to claim 1, characterized in that at at least one end of the rotor the power transmission includes a planet gearbox, which is arranged to be attached to the pivot joint arranged also to transmit a moment, and the rotor end in question is thus bearing-mounted on the frame structure using the bearings of the planet gearbox.

5. Crushing device according to claim 4, characterized in that the planet gearbox is arranged to form a hub motor that includes a reduction gear train, and to which a high-speed hydraulic motor is connected.

6. Crushing device according to claim 5, characterized in that the bearings are fitted between a case and a flange belonging to the hub motor.

7. Crushing device according to claim 6, characterized in that the pivot joint is attached to either the case or the flange.

8. Crushing device according to claim 6, characterized in that the hub motor is attached rigidly by its case to the rotor the pivot joint being between the flange and the frame structure.

9. Crushing device according to claim 5, characterized in that a hub motor is fitted to both ends of the rotor.

10. Crushing device according to claim 1, characterized in that the rotor is formed of a tube, in which there are flange ends for attaching the rotor.

11. Crushing device according to claim 10, characterized in that inside the tube is a medium filling and/or circulation for controlling the temperature of the power transmission connected to the rotor.

12. Crushing device according to claim 1, characterized in that the frame structure includes attachment lugs in both the upper and the lower part, for fitting the crushing device as part of a larger apparatus, which is arranged to be fixed or mobile.

* * * * *